US008726706B2

(12) United States Patent
Jacob

(10) Patent No.: US 8,726,706 B2
(45) Date of Patent: May 20, 2014

(54) LOCKING DEVICE

(75) Inventor: Dirk Jacob, Heiligenhaus (DE)

(73) Assignee: Huf Hulsbeck & Furst GmbH & Co. KG, Velbert (DE)

( * ) Notice: Subject to any disclaimer, the term of this patent is extended or adjusted under 35 U.S.C. 154(b) by 0 days.

(21) Appl. No.: 13/383,233

(22) PCT Filed: Jun. 30, 2010

(86) PCT No.: PCT/EP2010/059249
§ 371 (c)(1),
(2), (4) Date: Jan. 10, 2012

(87) PCT Pub. No.: WO2011/006756
PCT Pub. Date: Jan. 20, 2011

(65) Prior Publication Data

US 2012/0297843 A1 Nov. 29, 2012

(30) Foreign Application Priority Data

Jul. 15, 2009 (DE) ..... 10 2009 033 487

(51) Int. Cl.
*E05B 19/06* (2006.01)

(52) U.S. Cl.
USPC ..... 70/409; 70/356; 70/358; 70/492; 70/406

(58) Field of Classification Search
USPC ..... 70/356, 358, 492, 405–407, 409
See application file for complete search history.

(56) References Cited

U.S. PATENT DOCUMENTS 3,742,744 A * 7/1973 Lumme ..... 70/358
4,116,025 A * 9/1978 Wolter ..... 70/358

(Continued)

FOREIGN PATENT DOCUMENTS

CN 201056889 Y 5/2008
DE 897215 C 11/1953

(Continued)

OTHER PUBLICATIONS

German Search Report from corresponding German application No. 10 2009 033 487.4.

(Continued)

*Primary Examiner* — Suzanne Barrett
(74) *Attorney, Agent, or Firm* — Porzio, Bromberg & Newman, P.C.

(57) ABSTRACT

The invention relates to a locking device, in particular for a motor vehicle, having a key (10) and a lock cylinder (30), having a cylinder core (32), which is mounted in a rotatable manner in a cylinder housing (31) and has a key channel (33) into which the key (10) can be introduced, having spring-loaded tumbler elements (41, 42), which are mounted such that, when the key (10) is inserted into the key channel (33), they can be displaced radially in relation to the axis (34) of the lock cylinder (30), and having a plurality of outer surfaces (13, 14, 15), which are provided on the key (10), have control tracks (11, 12) and act on the tumbler elements (41, 42) when the key (10) is introduced. For this purpose, it is provided according to the invention that the outer surfaces (13, 14, 15) have two narrow sides (14, 15) and two broad sides (13), wherein each broad side (13) is configured with a first control track (11), the first narrow side (14) has a second control track (12), and the second narrow side (15), which is located opposite the first narrow side (14), is designed to be free of any control track.

13 Claims, 2 Drawing Sheets

(56) References Cited

U.S. PATENT DOCUMENTS

Figure 1:
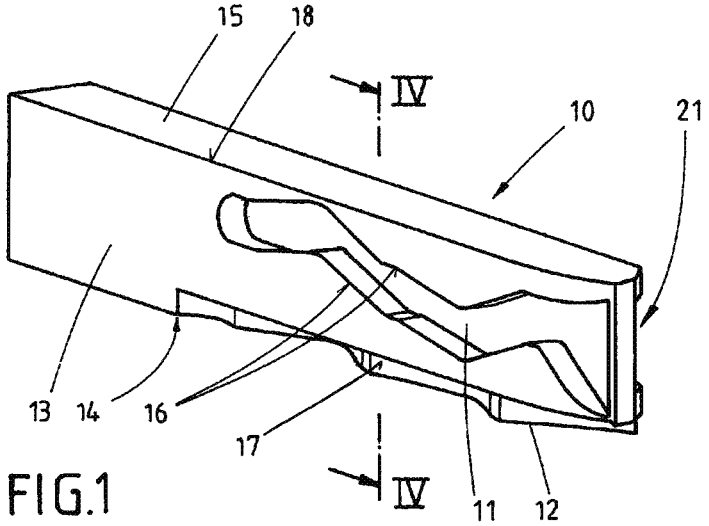

| | | | | |
|---|---|---|---|---|
| 4,221,121 | A * | 9/1980 | Tietz | 70/358 |
| 4,377,082 | A * | 3/1983 | Wolter | 70/493 |
| 4,516,416 | A * | 5/1985 | Prunbauer et al. | 70/276 |
| 4,612,787 | A * | 9/1986 | Prunbauer et al. | 70/358 |
| 4,667,495 | A * | 5/1987 | Girard et al. | 70/398 |
| 4,823,575 | A * | 4/1989 | Florian et al. | 70/358 |
| 7,337,639 | B2 * | 3/2008 | Edwards, Jr. | 70/409 |
| 7,484,392 | B2 * | 2/2009 | Katagiri | 70/492 |
| 8,261,588 | B2 * | 9/2012 | Šabata | 70/492 |
| 8,327,675 | B2 * | 12/2012 | Baumann | 70/494 |
| 2006/0000251 | A1 | 1/2006 | Ceron et al. | |
| 2008/0196461 | A1 * | 8/2008 | Widen | 70/409 |
| 2009/0025442 | A1 * | 1/2009 | Klein et al. | 70/492 |
| 2009/0266123 | A1 * | 10/2009 | Mueller et al. | 70/348 |
| 2009/0301149 | A1 * | 12/2009 | Widen | 70/358 |
| 2011/0252846 | A1 * | 10/2011 | Hertel et al. | 70/493 |
| 2011/0302972 | A1 * | 12/2011 | Higuchi | 70/491 |
| 2012/0073340 | A1 * | 3/2012 | Widen | 70/495 |
| 2012/0240645 | A1 * | 9/2012 | Mathachan | 70/491 |
| 2012/0279265 | A1 * | 11/2012 | Winkler et al. | 70/358 |
| 2013/0000368 | A1 * | 1/2013 | Habecke | 70/358 |

FOREIGN PATENT DOCUMENTS

| | | | |
|---|---|---|---|
| DE | 202005010309 | U1 | 11/2005 |
| DE | 102005058549 | A1 | 6/2007 |
| DE | 102007014900 | A1 | 10/2008 |
| EP | 0440983 | A2 | 8/1991 |
| FR | 2917444 | A1 | 12/2008 |
| GB | 2266918 | A | 11/1993 |
| JP | 53045191 | U | 4/1978 |
| WO | 2005094738 | A2 | 10/2005 |

OTHER PUBLICATIONS

Office Action from corresponding Chinese Patent Application No. 201080031643.2 dated Oct. 28, 2013.

* cited by examiner

LOCKING DEVICE

CROSS REFERENCE TO RELATED APPLICATION

This is a National Stage of International Application No. PCT/EP2010/059249, filed 30 Jun. 2010, which claims the benefit of Application No. 10 2009 033 487.4, filed in Germany on 15 Jul. 2009, the disclosures of which Applications are incorporated by reference herein.

The invention relates to a locking device, in particular of a motor vehicle, having a key and a lock cylinder, having a cylinder core, which is mounted in a rotatable manner in a cylinder housing and has a key channel into which the key can be introduced, having spring-loaded tumbler elements which are mounted such that, when the key is inserted into the key channel, they can be displaced radially to the cylinder axis of the lock cylinder, having several outer surfaces provided on the key, which have control tracks, which act on the tumbler elements when the key is introduced.

A locking device of the above-referenced type is disclosed in DE 10 2007 014 900 A1, wherein the key is embodied in each case with a control track on its two narrow sides as well as on its two broad sides. The referenced control tracks act on spring-loaded tumbler elements, which are arranged in the lock cylinder. It has been shown that tumbler elements of this type have proven useful in particular in connection with motor vehicles. In order to steal a motor vehicle, unauthorized persons try by means of break-in tools, for example by means of a so-called "picking system," to sort the tumbler elements in the key channel to the cross-section of the cylinder core, whereby the tumbler elements release the cylinder core for rotation.

It has been shown that in some cases of use smaller installation spaces are necessary for locking devices of this type, wherein at the same time a high safety against break-in of the locking device must be ensured.

To attain this object, a locking device with all of the technical features of claim 1 is proposed. Possible embodiments are suggested in the dependent claims.

According to the invention, the outer surfaces of the key have two narrow sides and two broad sides, wherein each broad side is embodied with a first control track, the first narrow side has a second control track, and the second narrow side lying opposite the first narrow side is embodied free of any control tracks. One of the essential advantages of this locking device according to the invention is that, due to the second narrow side of the key embodied free from any control tracks, on the one hand the lock cylinder as well as the cylinder core with the key channel can be embodied in a smaller and more compact manner. Furthermore, a more compact key is created, which requires a smaller installation space in the lock cylinder.

It can likewise be provided according to the invention that the tumbler element is embodied with at least one projection, which protrudes into the key channel when the key is not inserted, wherein the projection can be moved out of the key channel by the first or the second control track when the key is inserted, wherein in particular the tumbler element is embodied free from any projections on its side facing towards the second narrow side, in particular is adapted geometrically to the even, flat embodiment of the second narrow side. The control tracks hereby serve as a code track, wherein the code track is embodied with a profile that corresponds to the tumbler elements of the lock cylinder accordingly, that means that only the key with the correspondingly "correct" code track or code tracks causes a corresponding displacement of the tumbler elements out of the key channel in order to cause a movement of the cylinder core inside the cylinder housing when the key is inserted.

Advantageously, the second narrow side forms an even area in its total extension of the key. Due to the flat second narrow side, which bears against one of the four walls of the key channel, a tilting of the key is reduced in a simple manner, whereby a much lower wear of the lock cylinder and the tumbler elements occurs with a repeated insertion and actuation of the lock cylinder with the key.

One possible embodiment of the invention is that the first and/or the second control track is embodied as a control groove, wherein in particular the control groove has an essentially constant track width. Alternatively or additionally it is likewise conceivable that the first control track is a control groove and the second control track is a control rib. The control groove is hereby embodied in a concave manner, wherein the control rib is embodied in a convex manner on the outer surface of the key and its outer surface overlapped by the key.

Advantageously, the key can be inserted in only one position in the cylinder core so that this is not a reversible key. Expediently, the key is a solid component, in which the control tracks are sunk. The key height can be further reduced by means of the measure of a narrow side free from any control tracks. Through the resulting possible reduction in size of the key channel, the lock cylinder is also more secure against break in, since with each reduction in size a potential break in tool must likewise be smaller in order to be inserted into the key channel and also the maximum force that can be exerted is reduced.

Figure 2:
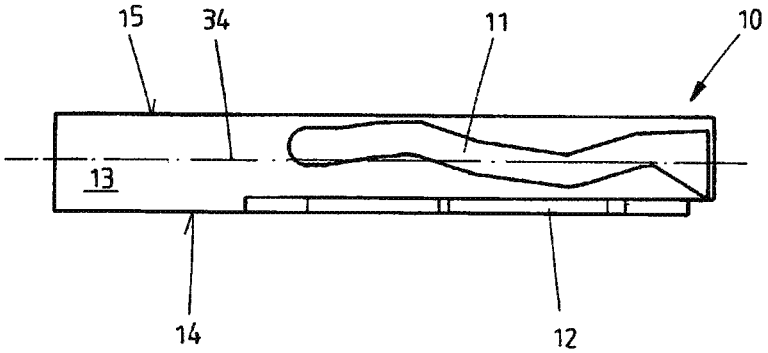
Figure 3:
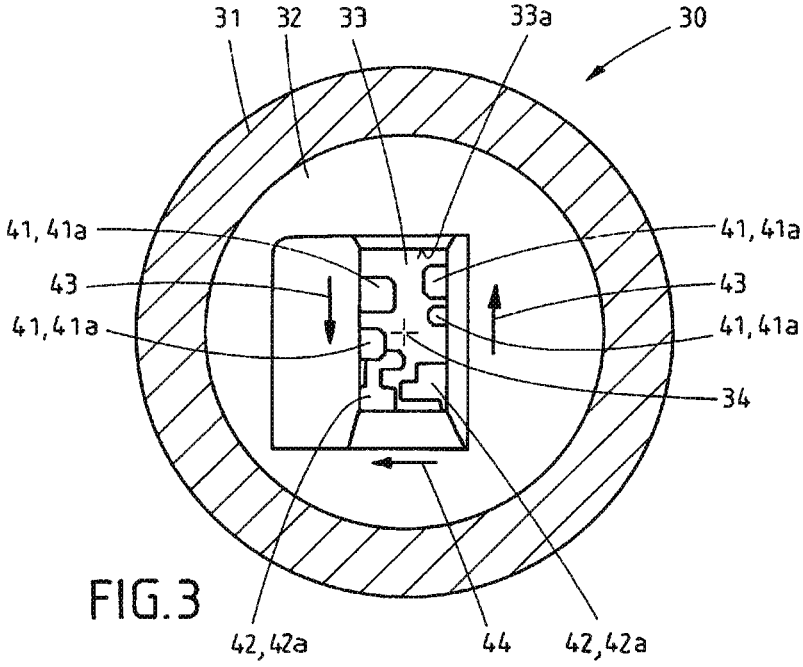
Figure 4:
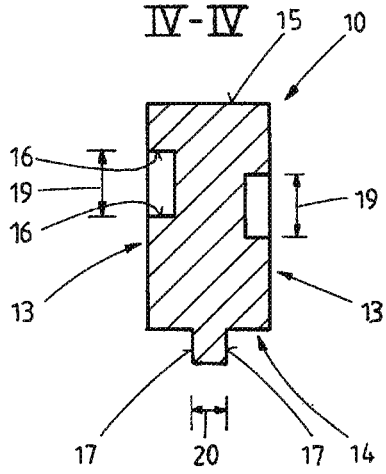

Further measures and advantages as well as technical features of the invention are shown by the claims, the following description and the drawings. The locking device according to the invention is shown in detail in an exemplary embodiment in the following figures. They show:

FIG. 1 A perspective view of the shaft of the key of the device according to the invention, FIG. 2 A side view of the key according to FIG. 1, FIG. 3 A diagrammatic representation of the lock cylinder into which the key according to FIG. 1 can be inserted and FIG. 4 A sectional view according to IV-IV from FIG. 1.

FIGS. 1 through 4 show purely diagrammatically a locking device of a motor vehicle with a key 10 and a lock cylinder 30, which is arranged in a vehicle door. The lock cylinder 30 has a cylinder housing 31, inside which a cylinder core 32 is mounted in a rotatable manner. The cylinder core 32 has numerous spring-loaded tumbler elements 41, 42. Furthermore, the cylinder core 32 is embodied with a key channel 33, in which the key 10 can be introduced.

If the key 10 is not inserted inside the key channel 33, the tumbler elements 41, 42 protrude with their projections 41*a*, 42*a* into the key channel 33 and at the same time block a rotation of the cylinder core 32 inside the cylinder housing 31, which is not explicitly shown in the drawing. In the present case, the tumbler elements 41, 42 are platelet tumbler elements. These tumbler elements 41, 42 are adjusted during the insertion of a proper "correct" key 10 such that the tumbler elements 41, 42 no longer protrude beyond the circumferential surface of the cylinder core 32, and the cylinder core 32 thus is rotatable in the cylinder housing 31. The user can thereupon unblock or block an actuation device of the motor vehicle by means of the locking device by a rotational movement of the inserted key 10, depending on the rotational direction of the key 10. A switch can likewise be actuated by means of the rotational movement of the key 10, which switch activates and/or deactivates the ignition, voltage for the electronic components of the motor vehicle, etc.

As can be clearly seen in FIG. 1 through FIG. 3, the key 10 has outer surfaces 13, 14, 15, which are embodied with control tracks 11, 12, which, when the key 10 is inserted into the key channel 33, act on the tumbler elements 41, 42 as well as on the projections 41*a*, 42*a* of the tumbler elements 41, 42. The outer surfaces 13, 14, 15 of the key 10 are embodied with two narrow sides 14, 15 and two broad sides 13. Each broad side 13 has a first control track 11, which is embodied as a control groove 11. That means that respectively one broad side 13 is provided with respectively one control groove 11. The first narrow side 14 is embodied with a second control track 12, which is a projecting control rib 12. The control grooves 11 and the control rib 12 are furthermore equipped with first guide surfaces 16 as well as second guide surfaces 17, which determine an individual topography of the control tracks 11, 12 and thus form a code track.

The second narrow side 15 of the key 10 is embodied as an even surface, that means that, in contrast to the first narrow side 14 and the two broad sides 13, the first narrow side 15 is embodied free of any control tracks. In the present exemplary embodiment the key 10 is formed by a square flat profile, wherein the second narrow side 15 is aligned at right angles to the broad sides 13. As can be clearly seen in FIG. 1 and FIG. 2, the first control track 11 extends along the longitudinal extension of the key 10, wherein the first control track 11 in some regions of the broad side 13 can run up to the common edge 18 of the broad side 13 and the second narrow side 15. As far as possible the entire height of the broad side 13 can thus be utilized for the first control track 11, whereby the compact construction of the key 10 is increased.

The control groove 11 is furthermore embodied at the free end 21 of the key 10 broadened in a funnel-like manner to the actual track width 19 of the control groove 11 in order to thread the key 10 more easily into the key channel 33 of the lock cylinder 30. In the remaining course outside the free end 21 of the key 10, the control groove 11 has a constant track width 19 on both sides of the broad side 13. The same also applies analogously to the control rib 12, which likewise has an essentially constant wall thickness 20, which can also be referred to as a rib width 20. Of course, the track width 19 as well as the rib width 20 can vary in different key sections, which is not explicitly shown.

As can be seen in FIG. 3, the tumbler elements 41, 42 which are supported in a displaceable manner inside the cylinder core 32, are embodied with at least one projection 41*a*, 42*a*. If the key 10 is not inserted in the key channel 33, as is shown in FIG. 3, the projections 41*a*, 42*a* protrude into the key channel 33. In the exemplary embodiment shown the lock cylinder 30 is equipped with two types of tumbler elements 41, 42. As indicated in FIG. 3, a first tumbler element 41 of the first type can be displaced in a first radial direction 43 to the cylinder axis 34, wherein the first radial direction 43 of the projections 41*a* which are located in the left region of the key channel 33 is directed downwards. The first radial direction 43 of the projections 41*a* which are located in the right region of the key channel 33 is hereby aligned in the opposite direction. The second tumbler element 42 of the second type is displaceable in a second radial direction 44, which is aligned perpendicular to the first radial direction 43.

The first control track 11 has first guide surfaces 16 and the second control track 12 has second guide surfaces 17. The first guide surfaces 16 hereby act on at least one first tumbler element 41 as well as the projection 41*a*. The second guide surfaces 17 act analogously on at least one second tumbler element 42 as well as the projection 42*a*. That means that during the insertion of the key 10 over the profiled guide surfaces 16, 17, the tumbler element 41, 42 are moved accordingly in the first and the second radial direction 43, 44 and thus sorted inside the cylinder core 32 so that when the key 10 is inserted a rotational movement of the key 10 and of the cylinder core 32 inside the cylinder housing 31 is possible.

The tumbler elements 41, 42 are embodied free of any projections on the side facing towards the second narrow side 15, that means that the tumbler elements 41, 42 in this region are geometrically adapted to the even, flat embodiment of the second narrow side 15. When the key 10 is inserted, the second narrow side 15 bears directly against the adjacent, facing wall 33*a* of the key channel 33.

In the present case, the arrangement of the first tumbler elements 41 and the second tumbler elements 42 is arranged in alternating sequence. A plurality of first tumbler elements 41 and second tumbler elements 42 is hereby provided inside the lock cylinder 30.

The control tracks 11, 12 described in the exemplary embodiment can of course be provided along the entire extension of the key 10. The extension lengths of the first and of the second control track 11, 12 can also differ in size. In the present exemplary embodiment the key 10 according to the invention can be inserted in only one possible position inside the key channel 33, that means that they key 10 cannot be used as a reversible key.

LIST OF REFERENCE NUMBERS

10 Key
11 First control track
12 Second control track
13 Outer surface, broad side
14 Outer surface first narrow side
15 Outer surface, second narrow side
16 First guide surface
17 Second guide surface
18 Edge
19 Track width
20 Wall thickness
21 Free end of 10
30 Lock cylinder
31 Cylinder housing
32 Cylinder core
33 Key channel
33*a* Wall
34 Cylinder axis
41 First tumbler element
41*a* Projection
42 Second tumbler element
42*a* Projection
43 First radial direction
44 Second radial direction

The invention claimed is:

1. A locking device, in particular of a motor vehicle, comprising a key and a lock cylinder, having a cylinder core, which is mounted in a rotatable manner in a cylinder housing and has a key channel adapted for receiving a key and, having spring-loaded tumbler elements which are mounted such that, when the key is inserted into the key channel, they can be displaced radially to a cylinder axis of the lock cylinder, a plurality of outer surfaces provided on the key have control tracks which act on the tumbler elements when the key is introduced, the outer surfaces have two narrow sides and two broad sides, wherein each broad side is embodied with a first control track, the first narrow side has a second control track, and the second narrow side lying opposite the first narrow side is embodied free of any control tracks; and wherein the first control track has first guide surfaces and the second control track has second guide surfaces, wherein the first guide surface acts on at least one first tumbler element and the second guide surface acts on at least one second tumbler element, wherein a displacement of the first tumbler element takes place in a first radial direction to the cylinder axis, and a displacement of the second tumbler element takes place in a second radial direction, which is perpendicular to the first radial direction, to the cylinder axis; and wherein the first radial direction is parallel to the respective broad side and the second radial direction is parallel to the narrow side of the key.

2. The locking device according to claim 1, wherein the tumbler element is embodied with at least one projection, which protrudes into the key channel when the key is not inserted, wherein the projection can be moved out of the key channel by the first or the second control track when the key is inserted, wherein the tumbler element is embodied free of any projections on its side facing towards the second narrow side, and is adapted geometrically to the even, flat embodiment of the second narrow side.

3. The locking device according to claim 1, wherein the key is a square flat profile, which has narrow sides and broad sides which respectively lie opposite one another in pairs.

4. The locking device according to claim 1, wherein the second narrow side forms an even area in its total extension of the key.

5. The locking device according to claim 1, wherein the first tumbler elements and the second tumbler elements are arranged in alternating sequence in the cylinder core.

6. The locking device according to claim 1, wherein the second narrow side is aligned at right angles to the broad sides.

7. The locking device according to claim 1, wherein the first control track runs up to the common edge of the broad side and the second narrow side.

8. The locking device according to claim 1, wherein the first and/or the second control track is embodied as a control groove, wherein the control groove has an essentially constant track width.

9. The locking device according to claim 1, wherein the first and/or the second control track is embodied as a control rib, wherein the control rib has a constant wall thickness.

10. The locking device according to claim 8, wherein the first control track is a control groove and the second control track is a control rib.

11. The locking device according to claim 1, wherein the key is a solid component, in which the control tracks are sunk.

12. The locking device according to claim 1, wherein the control groove is embodied at the free end of the key broadened in a funnel-like manner to the actual track width.

13. The locking device according to claim 1, wherein the key can be inserted in only one position into the cylinder core.

* * * * *